US009260884B2

(12) United States Patent
Li et al.

(10) Patent No.: US 9,260,884 B2
(45) Date of Patent: Feb. 16, 2016

(54) LOCK CYLINDER CAPABLE OF CHANGING A KEY MEMBER

(71) Applicant: TAIWAN FU HSING INDUSTRIAL CO., LTD., Kaohsiung (TW)

(72) Inventors: Tsung-Yu Li, Kaohsiung (TW); Shih-Min Lu, Kaohsiung (TW)

(73) Assignee: TAIWAN FU HSING INDUSTRIAL CO., LTD., Gangshan District, Kaohsiung (TW)

( * ) Notice: Subject to any disclaimer, the term of this patent is extended or adjusted under 35 U.S.C. 154(b) by 348 days.

(21) Appl. No.: 13/916,583

(22) Filed: Jun. 13, 2013

(65) Prior Publication Data

US 2014/0290317 A1 Oct. 2, 2014

(30) Foreign Application Priority Data

Mar. 27, 2013 (TW) ..... 102110920 A

(51) Int. Cl.
*E05B 27/00* (2006.01)

(52) U.S. Cl.
CPC ..... *E05B 27/005* (2013.01); *Y10T 70/7565* (2015.04); *Y10T 70/7605* (2015.04)

(58) Field of Classification Search
CPC ..... Y10T 70/7734; Y10T 70/7605; Y10T 70/774; Y10T 70/7599; Y10T 70/765; Y10T 70/7638; Y10T 70/7593; Y10T 70/7559; Y10T 70/7588; Y10T 70/7661; Y10T 70/7644; Y10T 70/7678; Y10T 70/7746
USPC ..... 70/493, 382–385, 368, 369, 371, 378
See application file for complete search history.

(56) References Cited

U.S. PATENT DOCUMENTS

| | | | | |
|---|---|---|---|---|
| 2,977,786 | A | 4/1961 | Kendrick | |
| 4,294,092 | A | 10/1981 | Haggstrom | |
| 4,741,188 | A * | 5/1988 | Smith | 70/383 |
| 4,747,281 | A * | 5/1988 | Monahan | 70/383 |
| 4,836,002 | A * | 6/1989 | Monahan | 70/382 |
| 6,425,274 | B1 | 7/2002 | Laitala | |
| 6,810,703 | B1 | 11/2004 | Huang | |
| 6,951,123 | B2 | 10/2005 | Chong | |
| 7,121,127 | B1 * | 10/2006 | Fan | 70/373 |
| 2005/0072199 | A1 | 4/2005 | Edwards, Jr. | |

FOREIGN PATENT DOCUMENTS

| | | |
|---|---|---|
| TW | M286263 | 1/2006 |
| TW | M293941 | 7/2006 |
| TW | 200844314 | 11/2008 |
| TW | 200918722 | 5/2009 |

* cited by examiner

*Primary Examiner* — Suzanne Barrett
(74) *Attorney, Agent, or Firm* — Winston Hsu; Scott Margo

(57) ABSTRACT

A lock cylinder includes a cylinder housing with a upper pin hole set and a replacing opening, a cylinder body with a lower pin hole set, a upper locking pin set, a second locking pin set and a clip member. The cylinder body is movably disposed inside the cylinder housing. The upper locking pin set is disposed inside the upper pin hole set for engaging the cylinder housing and the cylinder body. The second locking pin set is disposed inside the lower pin hole set for disengaging the cylinder housing from the cylinder body. The clip member constrains the cylinder body from sliding on the cylinder housing in a first position, and does not constrains the cylinder body from sliding on the cylinder housing in a second position. The cylinder body slides to a replacing position for replacing the second locking pin set via the replacing opening.

21 Claims, 12 Drawing Sheets

LOCK CYLINDER CAPABLE OF CHANGING A KEY MEMBER

BACKGROUND OF THE INVENTION

1. Field of the Invention

The present invention relates to a lock cylinder, and more particularly, to a lock cylinder capable of changing a key member.

2. Description of the Prior Art

Generally speaking, a lock cylinder is used for matching a key member, so that a user inserts a key member into a key slot on the lock cylinder for rotating the lock cylinder, so as to unlock/lock the door. However, the conventional lock cylinder can only match one single key member, and thus it is required to change whole mechanisms of the lock cylinder in case the user needs to change the key member due to practical demands. As a result, it results in inconvenience of the lock cylinder in use and does not facilitate implementation of the lock cylinder in market.

SUMMARY OF THE INVENTION

Thus, the present invention provides a lock cylinder capable of changing a key member for solving above drawbacks.

According to an embodiment of the present invention, a lock cylinder includes a cylinder housing, a cylinder body, an upper locking pin set, a lower locking pin set and a clip member. An upper pin hole set and a replacing opening are formed on the cylinder housing. The cylinder body is movably disposed inside the cylinder housing, and a lower pin hole set corresponding to the upper pin hole set is formed on the cylinder body. The upper locking pin set is disposed inside the upper pin hole set on the cylinder housing, and the upper locking pin set is for engaging the cylinder housing and the cylinder body. The lower locking pin set is disposed inside the lower pin hole set, and the lower locking pin set is for matching the key member, so as to drive the upper locking pin set to disengage the cylinder body from the cylinder housing. The clip member is disposed on the cylinder body and capable of rotating relative to the cylinder body between a first position and a second position, wherein the cylinder body is not movable in the cylinder housing when the clip member is at the first position and the cylinder body is movable in the cylinder housing to a replacing position for replacing the lower locking pin set via the replacing opening when the clip member is at the second position.

According to another embodiment of the present invention, the lock cylinder further includes an engaging slot structure and a sliding slot structure. The engaging slot structure is formed on the cylinder body, and the clip member is engaged inside the engaging slot structure and capable of rotating relative to the cylinder body along the engaging slot structure between the first position and the second position. The clip member cooperates with the engaging slot structure as being rotated to the first position, so as to constrain the cylinder body from sliding in the cylinder housing. The sliding slot structure is formed on the cylinder body and communicates with the engaging slot structure. The clip member is aligned with the sliding slot structure as being rotated to the second position, so that the clip member is movable along the sliding slot structure between the second position and a third position.

According to another embodiment of the present invention, the replacing opening on the cylinder housing misaligns the upper pin hole set on the cylinder housing, and the cylinder body is movable to the replacing position and the clip member is movable to the third position along the sliding slot structure simultaneously when the clip is rotated to the second position, so as to align the lower pin hole set with the replacing opening.

According to an embodiment of the present invention, a lock cylinder includes a cylinder housing, a cylinder body, a lower locking pin set and a clip member. The cylinder housing has a longitudinal axis and a replacing opening. The cylinder body is movably disposed inside the cylinder housing along the longitudinal axis and has a lower pin hole set. The lower locking pin set is disposed inside the lower pin hole set of the cylinder body. The clip member is disposed on the cylinder body and capable of rotating relative to the cylinder body between a first position and a second position, wherein the cylinder body is not movable along the longitudinal axis in the cylinder housing when the clip member is at the first position and the cylinder body is movable along the longitudinal axis in the cylinder housing to a replacing position where the lower pin hole set is align with the replacing opening so that the locking pin set is revealed and replaceable via the replacing opening when the clip member is at the second position.

In summary, the present invention utilizes the key member to drive the upper locking pin set to disengage the cylinder body from the cylinder housing. After the cylinder housing is disengaged from the cylinder body, the cylinder body can be rotated to move the lower pin hole set and the lower locking pin set disposed inside the lower pin hole set to the position nearby the replacing opening on the cylinder housing first, and then the clip member is rotated from the first position to the second position (e.g. the clip can be rotated in a manual manner) to allow the clip member to be movable between the second position and the third position along the sliding slot structure. At the meantime, the key member can pull the cylinder body to move the lower pin hole set and the lower locking pin set disposed inside the lower pin hole set to the place where the lower pin hole set aligns the replacing opening on the cylinder housing (i.e. the replacing position). Accordingly, the lower locking pin set can be taken out from the replacing, so as to replace the lower locking pin set. In such a manner, the lock cylinder can change the key member based on the aforesaid designs without changing whole mechanisms of the lock cylinder with the key member. Accordingly, the lock cylinder of the present invention can enhance convenience in use and further facilitate implementation in market. Furthermore, the lock cylinder of the present invention utilizes the catch and the clip member for positioning the cylinder body during the aforesaid rotation and pulling process. It provides operation feeling as well as positioning mechanism during the lower locking pin set is replaced, so as to enhance convenience of the lock cylinder as changing the key member.

These and other objectives of the present invention will no doubt become obvious to those of ordinary skill in the art after reading the following detailed description of the preferred embodiment that is illustrated in the various figures and drawings.

DETAILED DESCRIPTION

In the following detailed description of the embodiments, reference is made to the accompanying drawings which form a part hereof, and in which is shown by way of illustration specific embodiments in which the invention may be practiced. In this regard, directional terminology, such as "top," "bottom," etc., is used with reference to the orientation of the Figure(s) being described. The components of the present invention can be positioned in a number of different orientations. As such, the directional terminology is used for purposes of illustration and is in no way limiting. On the other hand, the drawings are only schematic and the sizes of components may be exaggerated for clarity. It is to be understood that other embodiments may be utilized and structural changes may be made without departing from the scope of the present invention. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," and "installed" and variations thereof herein are used broadly and encompass direct and indirect connections and installations. Accordingly, the drawings and descriptions will be regarded as illustrative in nature and not as restrictive.

Figure 1:
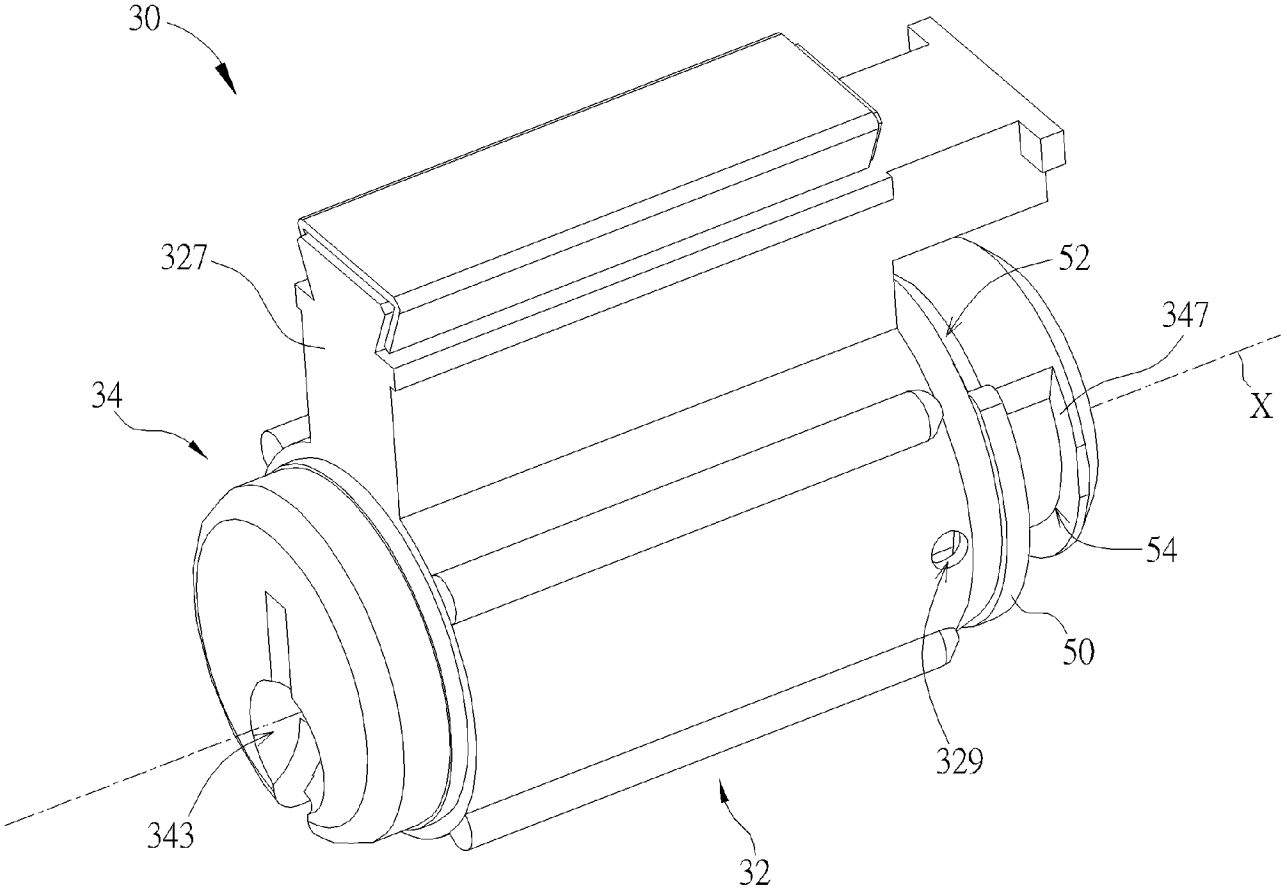
FIG. 1 is a schematic diagram of a lock cylinder according to an embodiment of the present invention.
Figure 2:
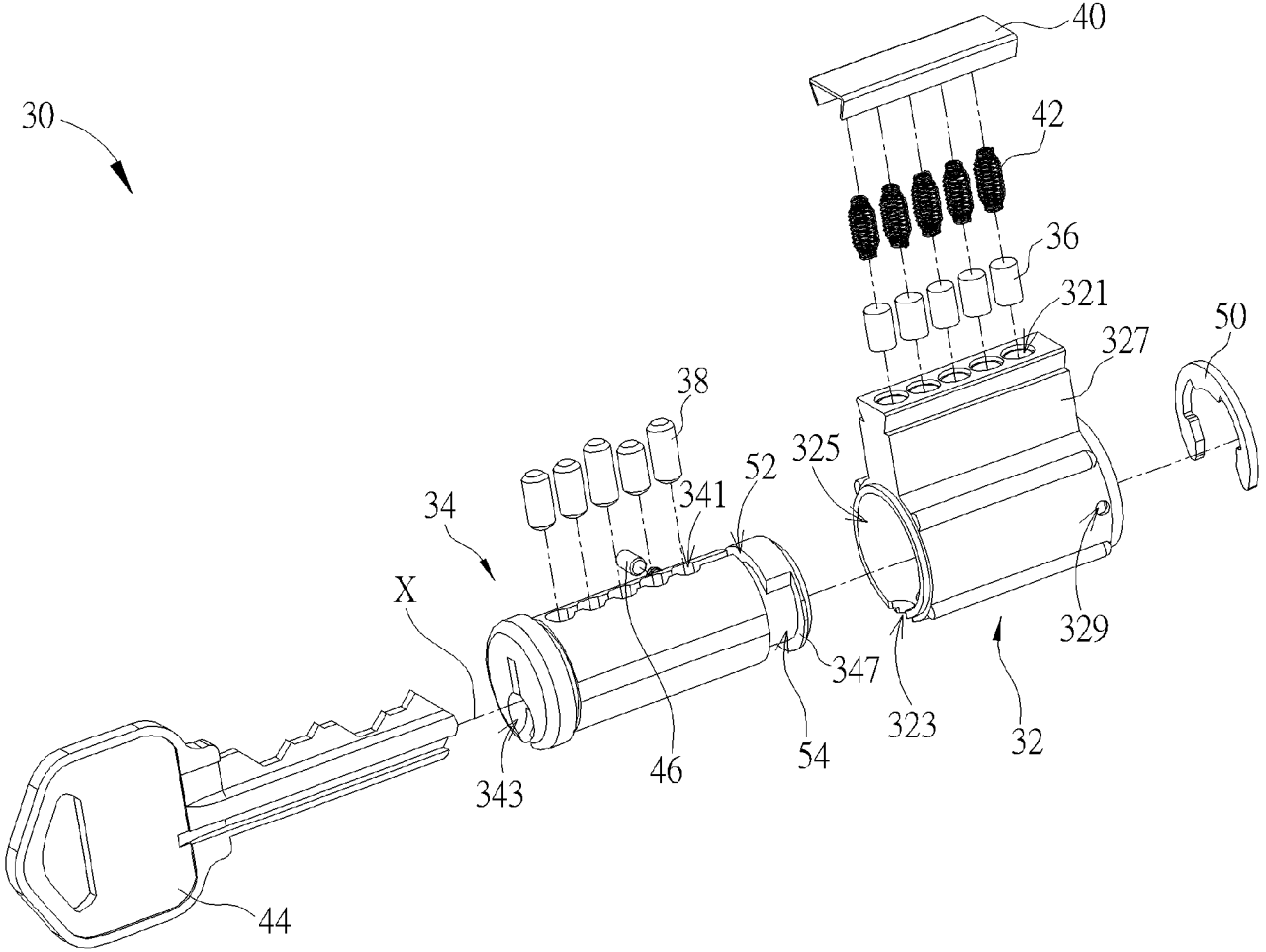
FIG. 2 is an exploded diagram of the lock cylinder according to the embodiment of the present invention.
Figure 3:
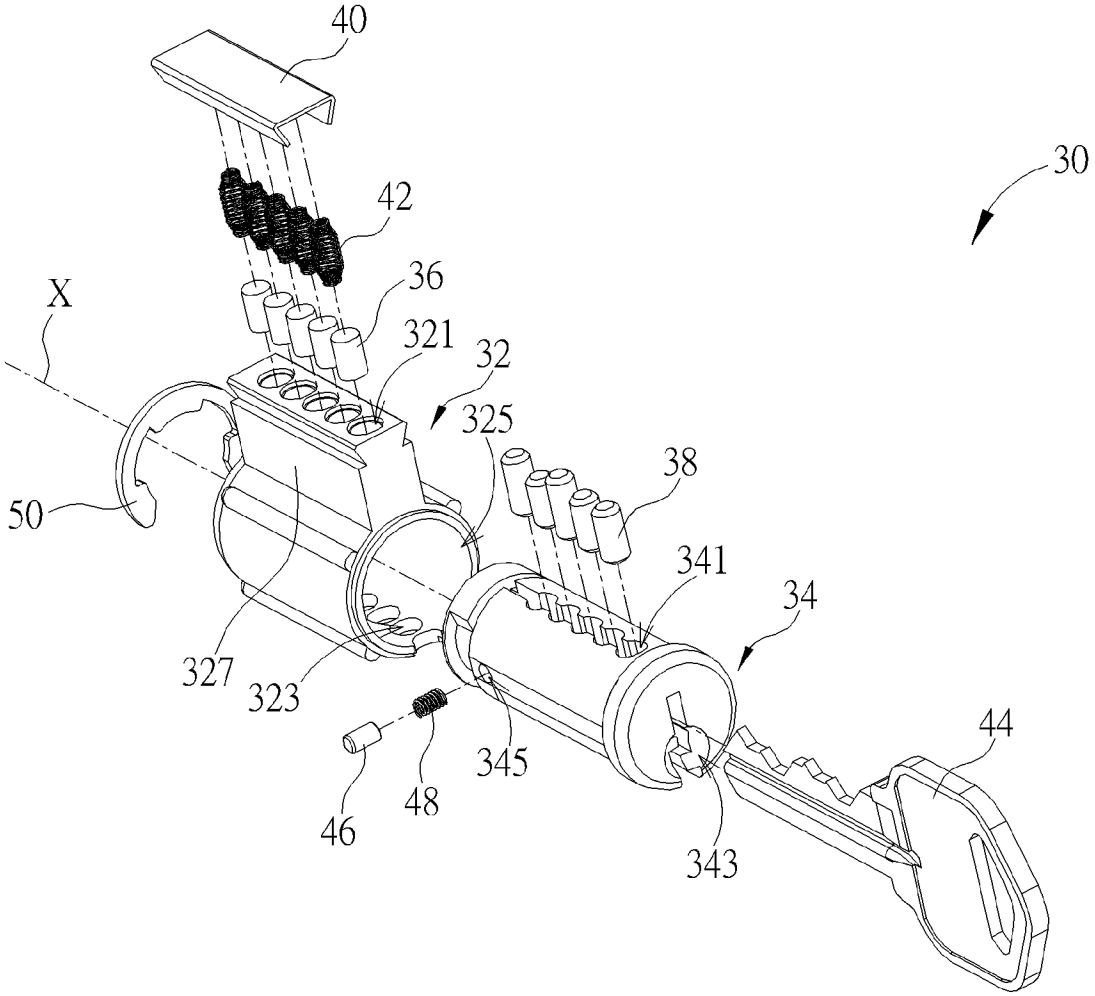
FIG. 3 is an exploded diagram of the lock cylinder in another view according to the embodiment of the present invention.

Please refer to FIG. 1 to FIG. 3. FIG. 1 is a schematic diagram of a lock cylinder 30 according to an embodiment of the present invention. FIG. 2 is an exploded diagram of the lock cylinder 30 according to the embodiment of the present invention. FIG. 3 is an exploded diagram of the lock cylinder 30 in another view according to the embodiment of the present invention. In this embodiment, the lock cylinder 30 is used for driving a latch assembly (not shown in figures) to separate from a wall, so as to unlock the door. As shown in FIG. 1 to FIG. 3, the lock cylinder 30 includes a cylinder housing 32 and a cylinder body 34. The cylinder housing 32 has a longitudinal axis X, and an upper pin hole set 321 and a replacing opening 323 misaligning the upper pin hole set 321 are formed on the cylinder housing 32. The cylinder body 34 is movably disposed inside the cylinder housing 32, and a lower pin hole set 341 corresponding to the upper pin hole set 321 is formed on the cylinder body 34.

Figure 4:
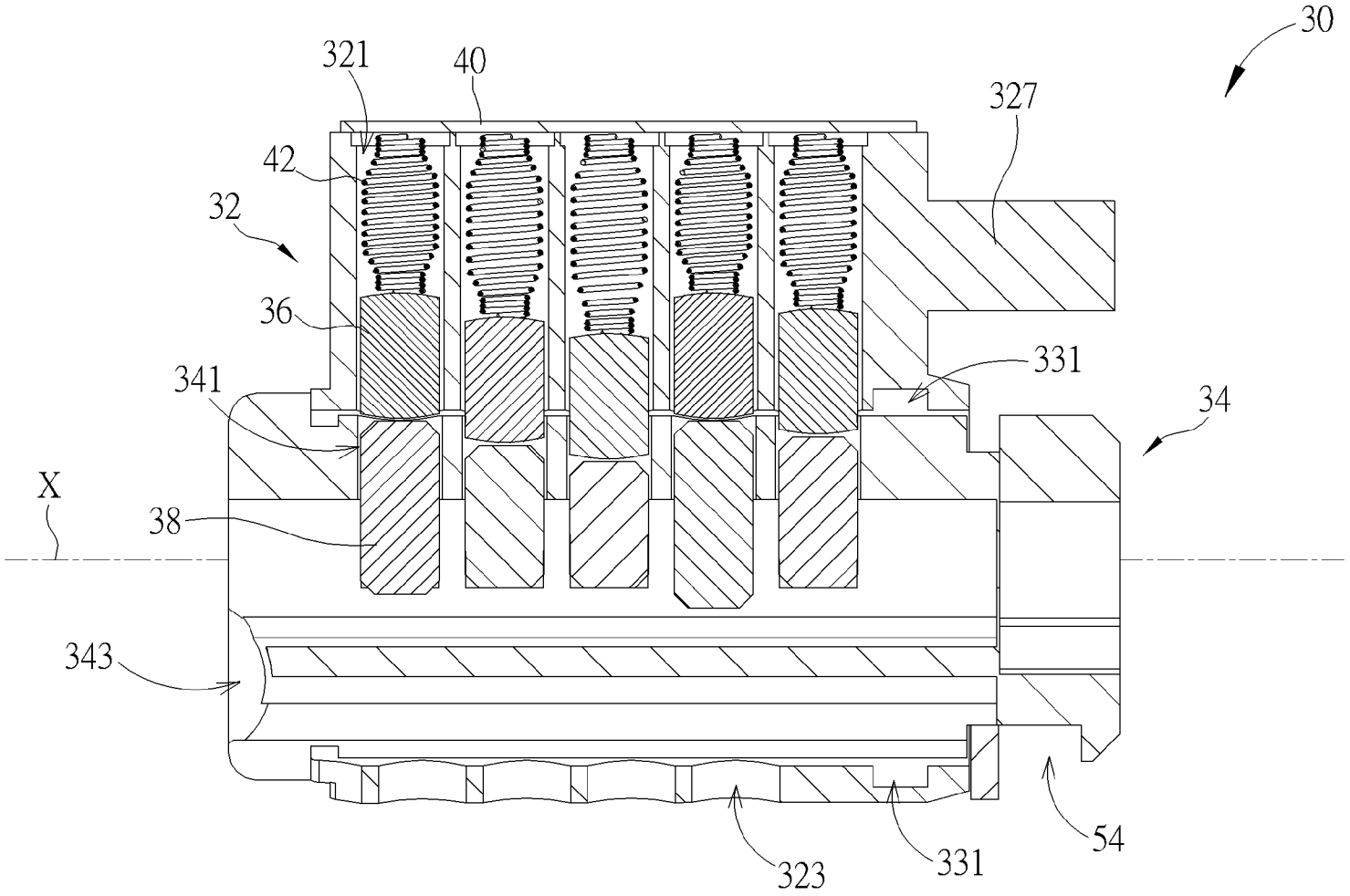
FIG. 4 is a sectional diagram of the lock cylinder in a locked status according to the embodiment of the present invention.

Please refer to FIG. 1 to FIG. 4. FIG. 4 is a sectional diagram of the lock cylinder 30 in a locked status according to the embodiment of the present invention. As shown in FIG. 1 to FIG. 4, a hollow chamber 325 is further formed on the cylinder housing 32 and communicates with the upper pin hole set 321 and the replacing opening 323. The cylinder body 34 is movably disposed inside the hollow chamber 325 on the cylinder housing 32, and the lock cylinder 30 further includes an upper locking pin set 36 disposed inside the upper pin hole set 321 on the cylinder housing 32. Accordingly, the upper locking pin set 36 can be used for engaging the cylinder housing 32 and the cylinder body 34. In other words, the upper locking pin set 36 is used for engaging with the cylinder housing 32 and the cylinder body 34, so as to constrain the cylinder body 34 from moving relative to the cylinder housing 32, i.e. the lock cylinder 30 can not drive the latch assembly to separate from the wall when the lock cylinder 30 is in the locked status as shown in FIG. 4, so that the latch assembly latches the door onto the wall.

Furthermore, a lug portion 327 is further formed on the cylinder housing 32 wherein the upper pin hole set 321 communicates with the hollow chamber 325 and a surface of the lug portion 327. The lock cylinder 30 further includes a lower locking pin set 38, a base 40 and a plurality of resilient members 42. The lower locking pin set 38 is disposed inside the lower pin hole set 341 on the cylinder body 34, and the lug portion 327 is disposed on the base 40. The plurality of resilient members 42 is disposed inside the upper pin hole set 321 on the cylinder housing 32 and is used for resiliently abutting against the base 40 and the upper locking pin set 36. Accordingly, the plurality of resilient members 42 can push the upper locking pin set 36 to abut against the lower locking pin set 38. Furthermore, a key slot 343 communicating with the lower pin hole set 341 on the cylinder body 34 is further formed on the cylinder body 34.

Figure 5:
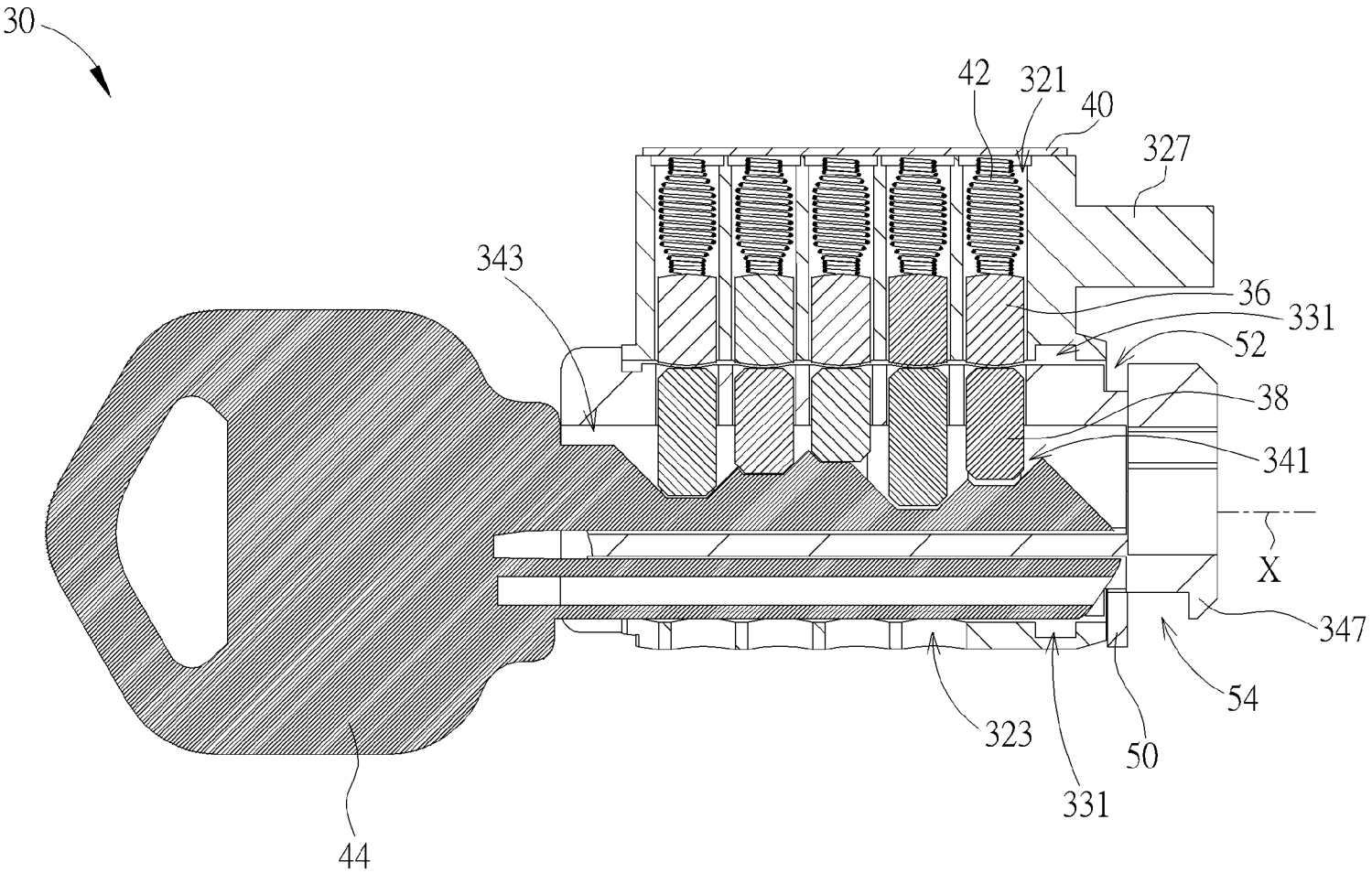
FIG. 5 is a sectional diagram of the lock cylinder in an unlocked status according to the embodiment of the present invention.

Please refer to FIG. 4 and FIG. 5. FIG. 5 is a sectional diagram of the lock cylinder 30 in an unlocked status according to the embodiment of the present invention. As shown in FIG. 4 and FIG. 5, when a key member 44 is inserted into the key slot 343, the key member 44 is capable of matching the lower locking pin set 38 inside the lower pin hole set 341. In other words, the key member 44 matches the lower locking pin set 38 via the key slot 343 to push the end of the upper locking pin set 36 which is disposed inside the lower pinhole set 341 to a surface of the hollow chamber 325 of the cylinder housing 32. Accordingly, the upper locking pin set 36 separates from the lower pin hole set 341 on the cylinder body 34, so that the upper locking pin set 36 is not engaged inside the lower pin hole set 341 on the cylinder body 34. In other words, the lower locking pin set 38 is used for matching the key member 44, so as to drive the upper locking pin set 36 to disengage the cylinder body 34 from the cylinder housing 32. In such a manner, the upper locking pin set 36 can not constrain the cylinder body 34 from moving relative to the cylinder housing 32.

Figure 6:
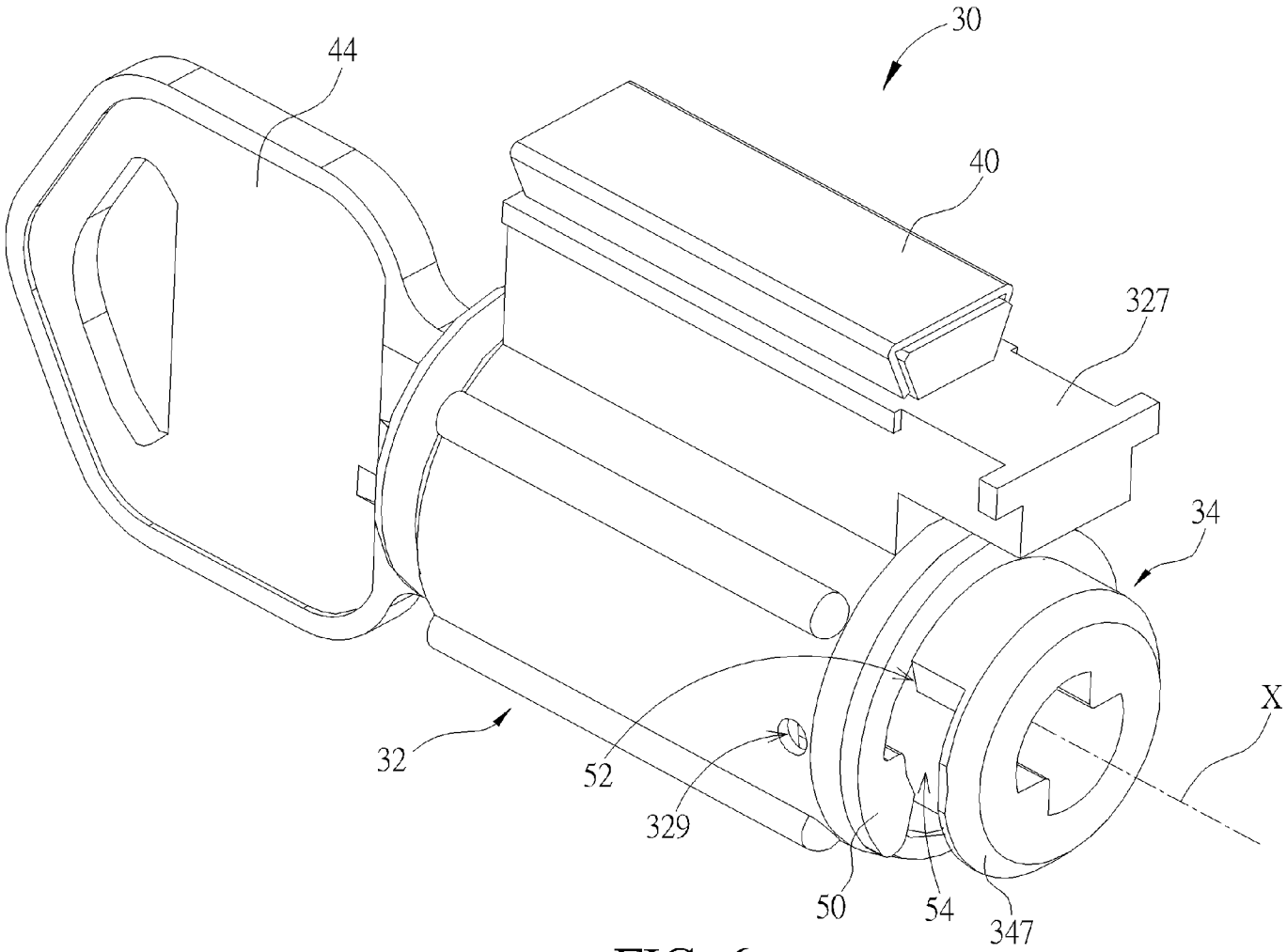
FIG. 6 is a diagram of the lock cylinder in a first status according to the embodiment of the present invention.
Figure 7:
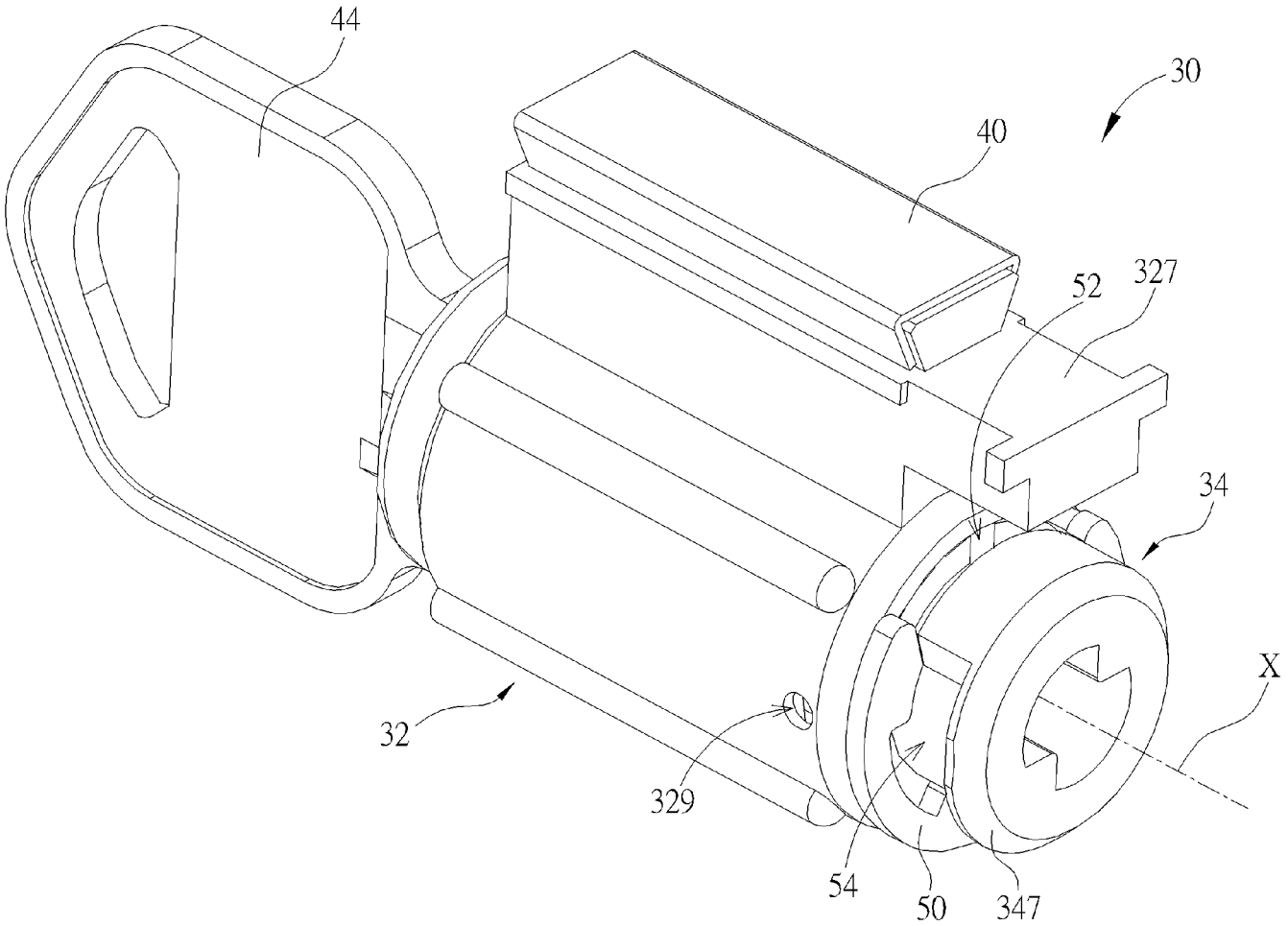
FIG. 7 is a diagram of the lock cylinder in a second status according to the embodiment of the present invention.
Figure 8:
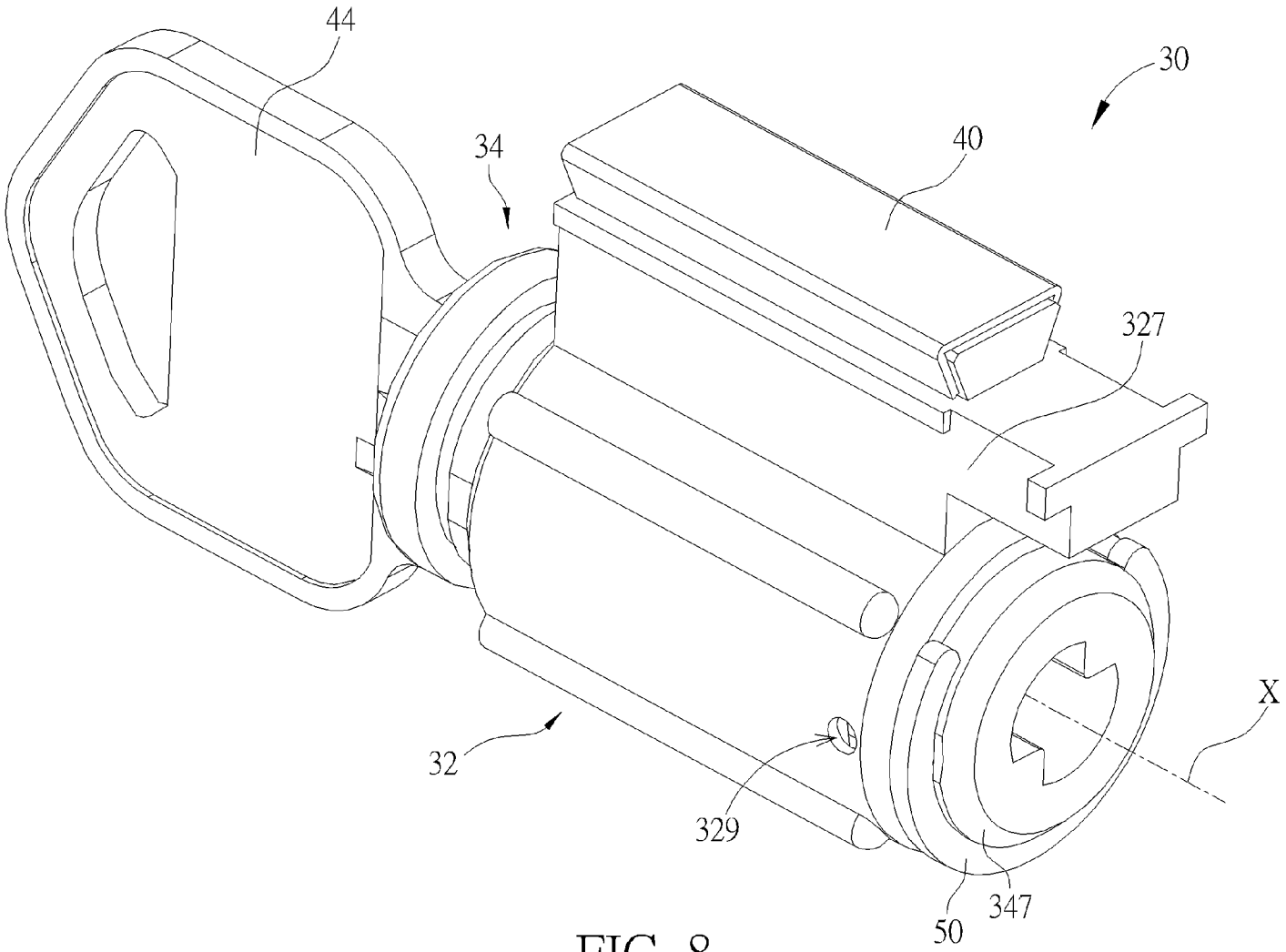
FIG. 8 is a diagram of the lock cylinder in a third status according to the embodiment of the present invention.
Figure 9:
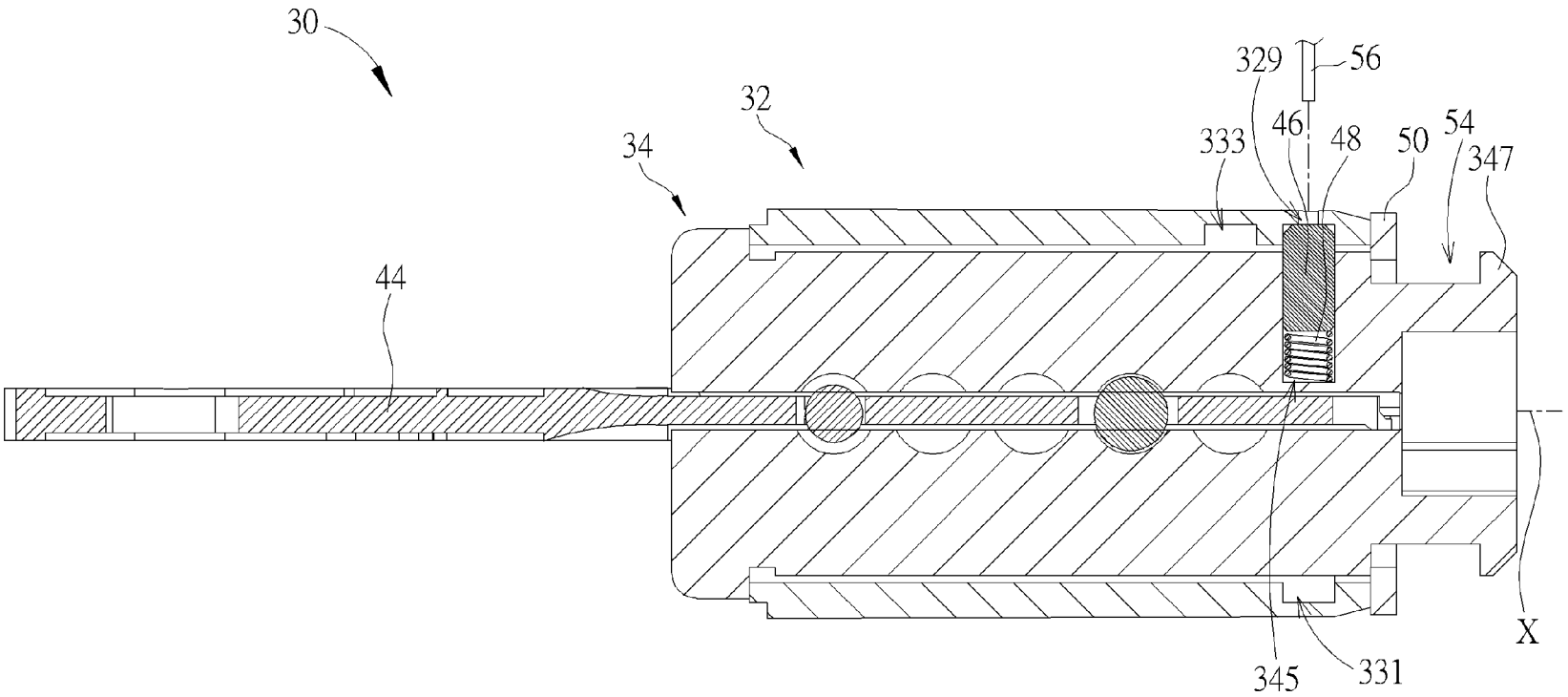
FIG. 9 is a sectional diagram of the lock cylinder in a first changing status and taken along a catch and a driving member according to the embodiment of the present invention.

Please refer to FIG. 1 to FIG. 9. FIG. 6 is a diagram of the lock cylinder 30 in a first status according to the embodiment of the present invention. FIG. 7 is a diagram of the lock cylinder 30 in a second status according to the embodiment of the present invention. FIG. 8 is a diagram of the lock cylinder 30 in a third status according to the embodiment of the present invention. FIG. 9 is a sectional diagram of the lock cylinder 30 in a first changing status and taken along the catch 46 and the driving member 48 according to the embodiment of the present invention. As shown in FIG. 1 to FIG. 9, an opening 329, an annular slot 331 and a positioning slot 333 are formed on the cylinder housing 32. The opening 329 is located within the annular slot 331, and the positioning slot 333 is nearby the annular slot 331. Furthermore, the lock cylinder 30 further includes a catch 46 and a driving member 48. As shown in FIG. 9, the catch 46 is disposed inside the annular slot 331 and movable along the annular slot 331. The driving member 48 resiliently abuts against the catch 46, so as to make the catch 46 abut against a bottom surface of the annular slot 331 during the catch 46 slides along the annular slot 331. Accordingly, the catch 46 can be engaged between the cylinder housing 32 and the cylinder body 34.

In this embodiment, the driving member 48 is a spring. A containing slot 345 is further formed on the cylinder body 34 for containing the spring (i.e. the driving member 48), so that the spring (i.e. the driving member 48) utilizes a bottom of the opening 329 as a support for resiliently abutting against the catch 46. In addition, the lock cylinder 30 further includes a clip member 50, an engaging slot structure 52 and a sliding slot structure 54. The clip member 50, the engaging slot structure 52 and the sliding slot structure 54 are all disposed on the cylinder body 34. The sliding slot structure 54 communicates with the engaging slot structure 52, and the clip member 50 is engaged inside the engaging slot structure 52. As shown in FIG. 5 to FIG. 8, after the key member 44 drives the upper locking pin set 36 to disengage the cylinder body 34 from the cylinder housing 32 via the key slot 343, as shown in FIG. 5, the key member 44 can rotate the cylinder body 34. At the meantime, the clip member 50 is located in a first position as shown in FIG. 6, i.e. the clip member 50 is engaged inside the engaging slot structure 52, so that the cylinder body 34 is not movable along the longitudinal axis X in the cylinder housing 32.

In other words, when the key member 44 disengages the cylinder body 34 from the cylinder housing 32 and when the clip member 50 is located in the first position as shown in FIG. 6, the clip member 50 is constrained by the engaging slot structure 52, so that the key member 44 only rotates the cylinder body 34 but can not pull the cylinder body 34. In other words, when the clip member 50 is located in the first position, the clip member 50 cooperates with the engaging slot structure 52, so as to constrain cylinder body 34 from sliding along the longitudinal axis X in the cylinder housing 32. Furthermore, when the clip member 50 is rotated from the first position shown in FIG. 6 to a second position shown in FIG. 7 along the engaging slot structure 52, the clip member 50 is aligned with the sliding slot structure 54. At the meantime, the clip member 50 can slide from the second position shown in FIG. 7 to a third position shown in FIG. 8 along the sliding slot structure 54.

Figure 10:
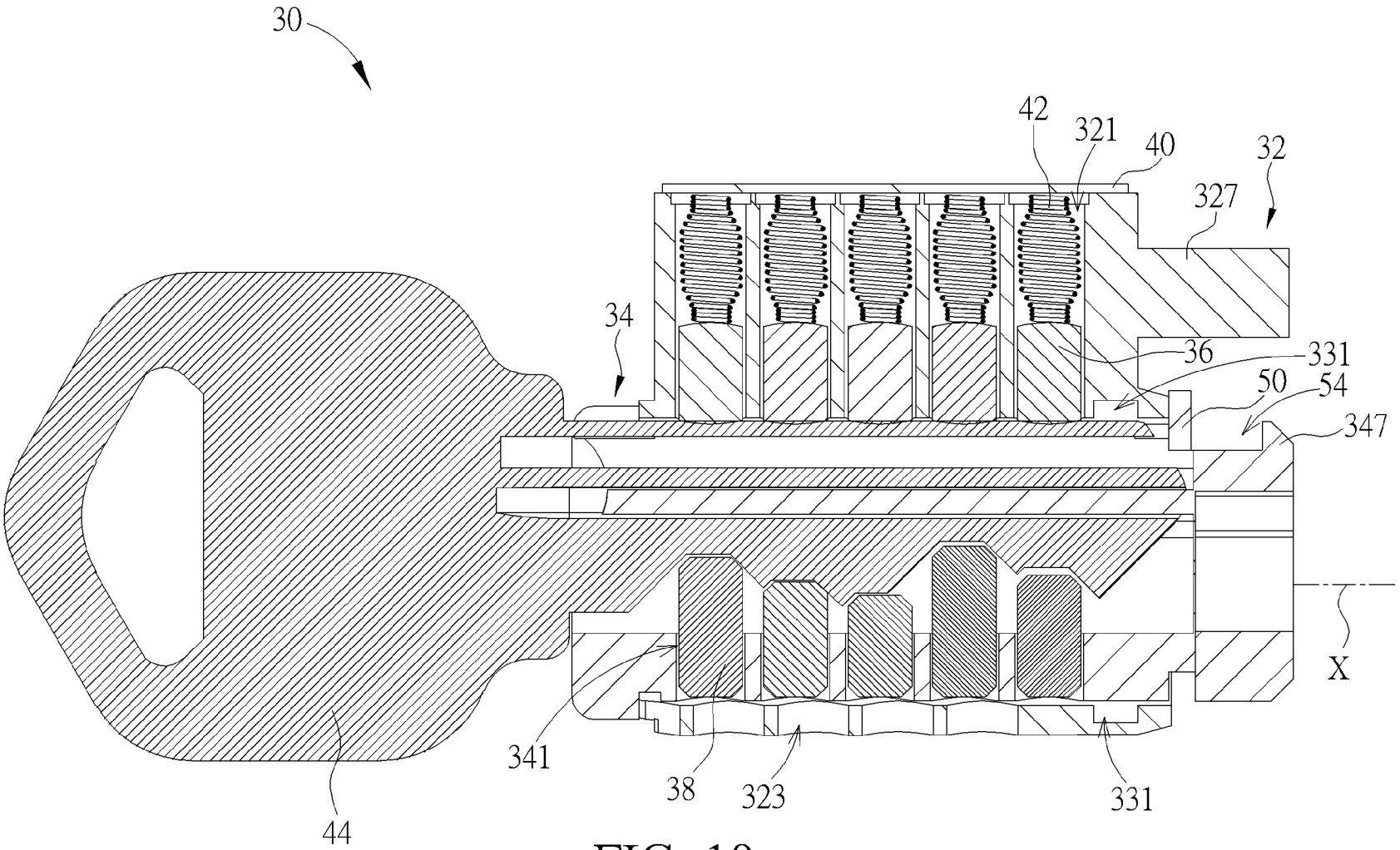
FIG. 10 is a sectional diagram of the lock cylinder in the first changing status and taken along a lower pin hole set according to the embodiment of the present invention.
Figure 11:
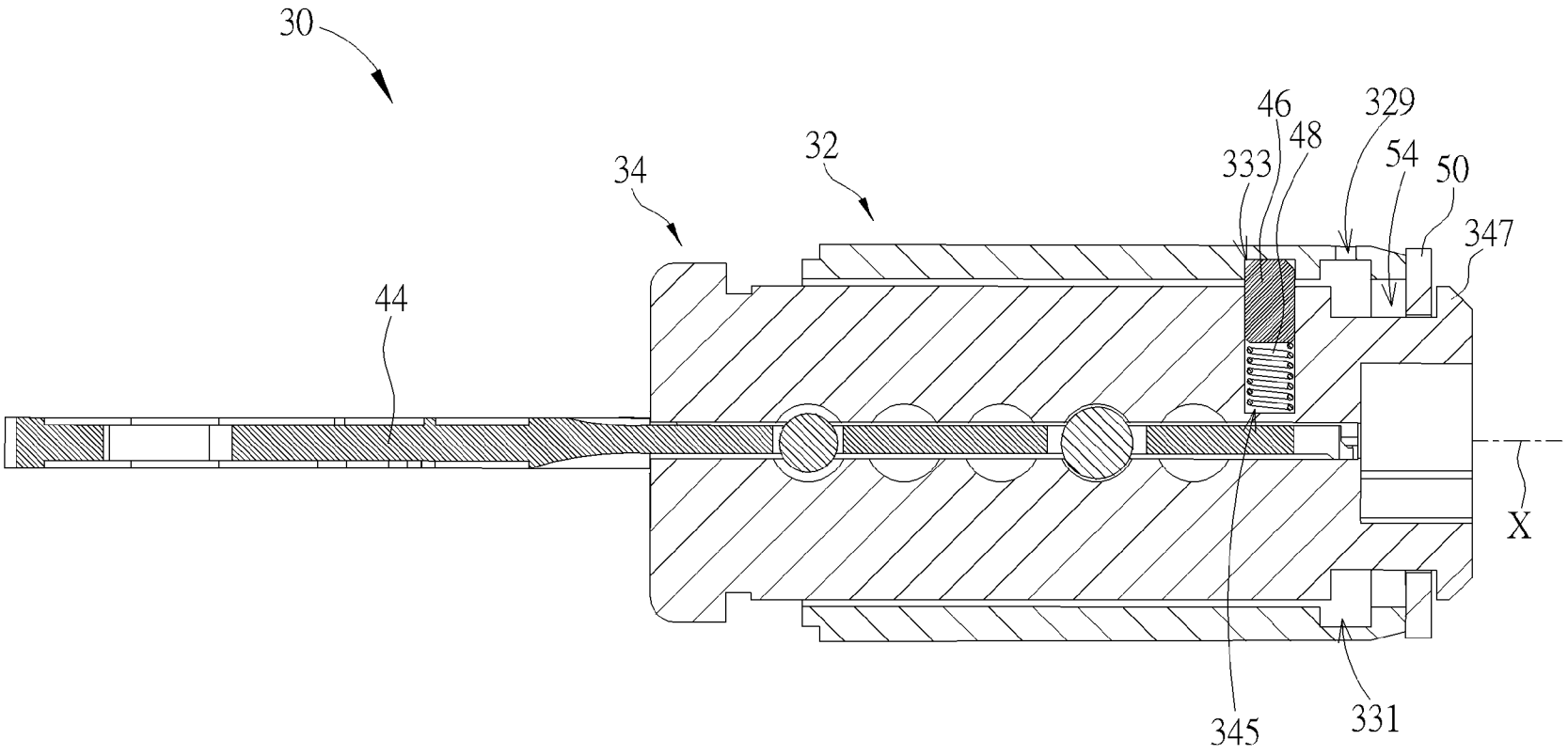
FIG. 11 is a sectional diagram of the lock cylinder in a second changing status and taken along the catch and the driving member according to the embodiment of the present invention.
Figure 12:
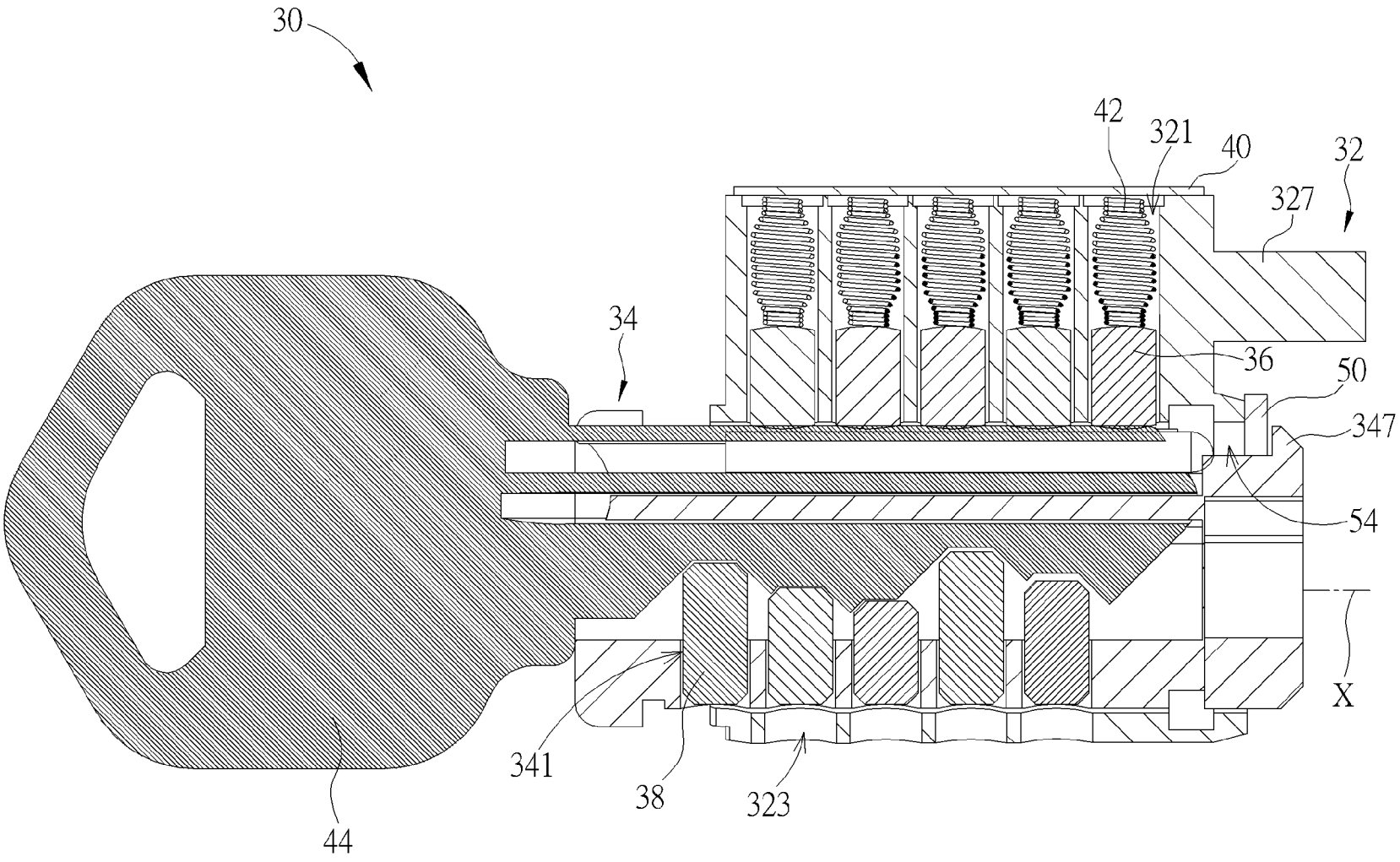
FIG. 12 is a sectional diagram of the lock cylinder in the second changing status and taken along the lower pin hole set according to the embodiment of the present invention.

More detailed descriptions for principles that the lock cylinder 30 changes the key member 44 are provided as follows. Please refer to FIG. 5 to FIG. 12. FIG. 10 is a sectional diagram of the lock cylinder 30 in the first changing status and taken along the lower pin hole set 341 according to the embodiment of the present invention. FIG. 11 is a sectional diagram of the lock cylinder 30 in a second changing status and taken along the catch 46 and the driving member 48 according to the embodiment of the present invention. FIG. 12 is a sectional diagram of the lock cylinder 30 in the second changing status and taken along the lower pin hole set 341 according to the embodiment of the present invention.

As shown in FIG. 5 to FIG. 12, when the key member 44 drives the upper locking pin set 36 to disengage the cylinder body 34 from the cylinder housing 32 via the key slot 343, as shown in FIG. 5, the key member 44 drives the cylinder body 34 to rotate relative to the cylinder housing 32. Furthermore, during the key member 44 rotates the cylinder body 34 relative to the cylinder housing 32, the cylinder body 34 activates the catch 46 to slide along the annular slot 331 on the cylinder housing 32. When the catch 46 is slid along the annular slot 331 on the cylinder housing 32 to a position shown in FIG. 9, the catch 46 aligns with the opening 329 on the cylinder housing 32. At the meantime, the catch 46 can be engaged with the opening 329. In this embodiment, the opening 329 is a through hole structure. On the other hand, when the cylinder body 34 is slid to a position where the catch 46 aligns the opening 329 on the cylinder housing 32, as shown in FIG. 9, the lower pin hole set 341 on the cylinder body 34 and the lower locking pin set 38 disposed inside the lower pin hole set 341 are rotated with the cylinder body 34 to a position nearby the replacing opening 323 on the cylinder housing 32, as shown in FIG. 10.

When the catch 46 is engaged with the opening 329, the clip member 50 can be rotated in a manual manner from the first position where the clip member 50 misaligns the sliding slot structure 54 shown in FIG. 6 to the second position where the clip member 50 aligns the sliding slot structure 54 shown in FIG. 7. For example, since the engaging slot structure 52 is an annular recessed structure which allows the clip member 50 to rotate along the engaging slot structure 52 due to no interferences along the path with the engaging slot structure 52 along which the clip member 50 rotates. Accordingly, a user is able to manually rotate the clip member 50, e.g., the user can use fingers to grasp the clip member 50 so as to rotate the clip member 50 along the path within the engaging slot structure 52 relative to the cylinder body 34. Alternatively, when the key member 44 drives the cylinder body 34 to rotate relative to the cylinder housing 32, it simultaneously drives the clip member 50 to the second position. Afterwards, a pushing member 56 (e.g. a steel wire) can be utilized for pushing the catch 46, so as to compress the driving member 48, as shown in FIG. 9. Accordingly, the catch 46 can disengage from the cylinder housing 32, so that the key member 44 pulls the cylinder body 34 to slide relative to the cylinder housing 32. In other words, when the key member 44 is desired to be utilized for pulling the cylinder body 34 to slide relative to the cylinder housing 32, it is required to release sliding constraint of the clip member 50 implemented between the cylinder body 34 and the cylinder housing 32 and to release engagement of the catch 46 implemented to the cylinder housing 32 and the cylinder body 34.

When the cylinder body 34 is pulled to where the clip member 50 is located in the third position, as shown in FIG. 8, the catch 46 is slid to a position shown in FIG. 11 along the cylinder housing 32. At the meantime, the catch 46 aligns with the positioning slot 333 on the cylinder housing 32, and the driving member 48 drives the catch 46 to be engaged in the positioning slot 333, so as to position the cylinder body 34 in a replacing position shown in FIG. 11. On the other hand, when the cylinder body 34 is pulled by the key member 44 to slide the clip member 50 to the third position along the sliding slot structure 54, the lower pin hole set 341 on the cylinder body 34 and the lower locking pin set 38 disposed inside the lower pin hole set 341 are pulled from the position nearby the replacing opening 323 on the cylinder housing 32 shown in FIG. 10 to a position where the lower pin hole set 341 aligns with the replacing opening 323 on the cylinder housing 32 shown in FIG. 12 (i.e. the replacing position) along the longitudinal axis X. At the meantime, the lower locking pin set 38 disposed inside the lower pin hole set 341 is revealed and is capable of being taken out via the replacing opening 323 on the cylinder housing 32, and another lower locking pin set can be placed into the lower pin hole set 341 via the replacing opening 323 on the cylinder housing 32. In such a manner, the other lower locking pin set can be used for matching another key member, so that the lock cylinder 30 capable of changing the key member 44 is achieved. In this embodiment, the cylinder body 34 includes a constraining structure 347 formed on the end portion of the cylinder housing 34 and connected to the sliding slot structure 54. When the key member 44 pulls the cylinder housing 34 to the position shown in FIG. 8, the constraining structure 347 is used for constraining the clip member 50 in the third position and further for preventing the clip member 50 from separating from the sliding slot structure 54 on the cylinder housing 34.

Compared to the prior art, the present invention utilizes the key member to drive the upper locking pin set to disengage the cylinder body from the cylinder housing. After the cylinder housing is disengaged from the cylinder body, the cylinder body can be rotated to move the lower pin hole set and the lower locking pin set disposed inside the lower pin hole set to the position nearby the replacing opening on the cylinder housing first, and then the clip member is rotated from the first position to the second position (e.g. the clip can be rotated in a manual manner) to allow the clip member to be movable between the second position and the third position along the sliding slot structure. At the meantime, the key member can pull the cylinder body to move the lower pin hole set and the lower locking pin set disposed inside the lower pin hole set to the place where the lower pin hole set aligns with the replacing opening on the cylinder housing (i.e. the replacing position). Accordingly, the lower locking pin set can be taken out from the replacing opening, so as to replace the lower locking pin set. In such a manner, the lock cylinder can change the key member based on the aforesaid designs without changing whole mechanisms of the lock cylinder with the key member. Accordingly, the lock cylinder of the present invention can enhance convenience in use and further facilitate implementation in market. Furthermore, the lock cylinder of the present invention utilizes the catch and the clip member for positioning the cylinder body during the aforesaid rotation and pulling process. It provides operation feeling as well as positioning mechanism during the lower locking pin set is replaced, so as to enhance convenience of the lock cylinder as changing the key member.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A lock cylinder capable of changing a key member, comprising:

a cylinder housing whereon an upper pin hole set and a replacing opening are formed;

a cylinder body movably disposed inside the cylinder housing, a lower pin hole set being formed on the cylinder body;

an engaging slot structure formed on the cylinder body;

a sliding slot structure formed on the cylinder body and communicating with the engaging slot structure;

an upper locking pin set disposed inside the upper pin hole set on the cylinder housing, the upper locking pin set being for engaging the cylinder housing and the cylinder body;

a lower locking pin set disposed inside the lower pin hole set, the lower locking pin set being for matching the key member, so as to drive the upper locking pin set to disengage the cylinder body from the cylinder housing; and a clip member engaging with the engaging slot structure and capable of rotating along the slot structure between a first position and a second position, wherein the clip member cooperates with the engaging slot structure when the clip member is at the first position so as to constrain the cylinder body from sliding relative to the cylinder housing, and the clip member aligns with the sliding slot structure when the clip member is rotated to the second position so as to disengage constraint of the cylinder body from the cylinder housing by the clip member, so that the cylinder body is able to slide from the second position to a replacing position for detaching the lower locking pin set via the replacing opening.

2. The lock cylinder of claim 1, wherein the replacing opening on the cylinder housing misaligns the upper pin hole set on the cylinder housing, the cylinder body is movable to the replacing position and the clip member is movable to the third position along the sliding slot structure when the clip is rotated to the second position, so as to align the lower pin hole set with the replacing opening.

3. The lock cylinder of claim 1, wherein an opening is further formed on the cylinder housing, and the lock cylinder further comprises:

a catch engaged between the cylinder housing and the cylinder body; and a driving member resiliently abutting against the cylinder body and the catch, wherein when the clip member is rotated to the second position, the catch is engaged with the opening and is capable of being pushed by a pushing member for disengaging from the cylinder housing.

4. The lock cylinder of claim 3, wherein an annular slot is further formed on the cylinder housing, and the catch slides along the annular slot during the key member rotates the cylinder body.

5. The lock cylinder of claim 4, wherein a positioning slot is further formed on the cylinder housing, and the catch is engaged in the positioning slot for positioning the cylinder body when the cylinder body slides to the replacing position.

6. The lock cylinder of claim 3, wherein the opening is a through hole structure, the driving member is a spring, and a containing slot is further formed on the cylinder body for containing the spring.

7. The lock cylinder of claim 1, wherein the cylinder body comprises:

a constraining structure formed on the cylinder body and connected to the sliding slot structure, the constraining structure being for constraining the clip member from separating from the sliding slot structure when the clip member slides along the sliding slot structure.

8. The lock cylinder of claim 1, wherein a hollow chamber is further formed on the cylinder housing and communicates with the upper pin hole set and the replacing opening, the cylinder body is movably disposed inside the hollow chamber, and the lower locking pin set pushes the upper locking pin set to a surface of the hollow chamber for driving the upper locking pin set to disengage the cylinder body from the cylinder housing when lower locking pin set matches the key member.

9. The lock cylinder of claim 1, wherein a lug portion is further formed on the cylinder housing, the upper pin hole set communicates with the hollow chamber and a surface of the lug portion, and the cylinder body further comprises:

a base disposed on the lug portion; and a plurality of resilient members disposed inside the upper pin hole set, the plurality of resilient members being for resiliently abutting against the base and the upper locking pin set.

10. A lock cylinder, comprising:

a cylinder housing having a longitudinal axis and a replacing opening;

a cylinder body movably disposed inside the cylinder housing along the longitudinal axis and having a lower pin hole set;

an engaging slot structure formed on the cylinder body;

a sliding slot structure formed on the cylinder body and communicating with the engaging slot structure;

a lower locking pin set disposed inside the lower pin hole set of the cylinder body; and a clip member engaging with the engaging slot structure and capable of rotating along the slot structure between a first position and a second position, wherein the clip member cooperates with the engaging slot structure when the clip member is at the first position so as to constrain the cylinder body from sliding relative to the cylinder housing, and the clip member aligns with the sliding slot structure when the clip member is rotated to the second position so as to disengage constraint of the cylinder body from the cylinder housing by the clip member, so that the cylinder body is able to slide from the second position to a replacing position for detaching the lower locking pin set via the replacing opening.

11. The lock cylinder of claim 10, wherein the cylinder body is movable to the replacing position and the clip member is movable to the third position along the sliding slot structure when the clip is rotated to the second position.

12. The lock cylinder of claim 10, wherein an opening is further formed on the cylinder housing, and the lock cylinder further comprises:

a catch engaged between the cylinder housing and the cylinder body; and a driving member resiliently abutting against the cylinder body and the catch, wherein when the clip member is rotated to the second position, the catch is engaged with the opening and is capable of being pushed by a pushing member for disengaging from the cylinder housing.

13. The lock cylinder of claim 12, wherein an annular slot is further formed on the cylinder housing, and the catch is slidable along the annular slot.

14. The lock cylinder of claim 13, wherein a positioning slot is further formed on the cylinder housing, and the catch is engaged in the positioning slot for positioning the cylinder body when the cylinder body slides to the replacing position.

15. The lock cylinder of claim 12, wherein the opening is a through hole structure, the driving member is a spring, and a containing slot is further formed on the cylinder body for containing the spring.

16. The lock cylinder of claim 10, wherein the cylinder body comprises:

a constraining structure formed on the cylinder body and connected to the sliding slot structure, the constraining structure being for constraining the clip member from separating from the sliding slot structure when the clip member slides along the sliding slot structure.

17. The lock cylinder of claim 10, wherein a hollow chamber is further formed on the cylinder housing and communicates with the replacing opening, the cylinder body is movably disposed inside the hollow chamber.

18. A lock cylinder capable of changing a key member, comprising:

a cylinder housing whereon an opening, an annular slot, an upper pin hole set and a replacing opening are formed;

a cylinder body movably disposed inside the cylinder housing, a lower pin hole set being formed on the cylinder body;

a lower locking pin set disposed inside the lower pin hole set of the cylinder body;

a clip member disposed on the cylinder body and capable of rotating relative to the cylinder body between a first position and a second position, wherein the cylinder body is not movable in the cylinder housing when the clip member is at the first position and the cylinder body is movable in the cylinder housing to a replacing position for replacing the lower locking pin set via the replacing opening when the clip member is at the second position a catch engaged between the cylinder housing and the cylinder body; and a driving member resiliently abutting against the cylinder body and the catch, wherein when the clip member is rotated to the second position, the catch is engaged with the opening and is capable of being pushed by a pushing member for disengaging from the cylinder housing.

19. The lock cylinder of claim 18, further comprising:

an upper locking pin set disposed inside the upper pin hole set on the cylinder housing.

20. The lock cylinder of claim 18, wherein a positioning slot is further formed on the cylinder housing, and the catch is engaged in the positioning slot for positioning the cylinder body when the cylinder body slides to the replacing position.

21. The lock cylinder of claim 18, wherein the opening is a through hole structure, the driving member is a spring, and a containing slot is further formed on the cylinder body for containing the spring.

* * * * *